US009052157B1

(12) United States Patent
Montes

(10) Patent No.: US 9,052,157 B1
(45) Date of Patent: Jun. 9, 2015

(54) REVOLVING REAR SLING MOUNT FOR A FIREARM

(71) Applicant: Kenneth Montes, Roseville, CA (US)

(72) Inventor: Kenneth Montes, Roseville, CA (US)

(73) Assignee: Phase 5 Weapon Systems Inc., Roseville, CA (US)

( * ) Notice: Subject to any disclaimer, the term of this patent is extended or adjusted under 35 U.S.C. 154(b) by 0 days.

(21) Appl. No.: 13/741,987

(22) Filed: Jan. 15, 2013

(51) Int. Cl.
*F41C 23/02* (2006.01)
*F41C 33/00* (2006.01)

(52) U.S. Cl.
CPC ..... *F41C 33/002* (2013.01)

(58) Field of Classification Search
CPC ..... F41C 23/02; F41C 23/16; F41C 23/22; F41C 27/00; F41C 33/002; F41G 11/003; Y10S 224/913
USPC ..... 42/85, 72, 73, 75.03; 89/1.815; 384/129, 209, 275; 24/643; 224/149; 124/10
See application file for complete search history.

(56) References Cited

U.S. PATENT DOCUMENTS

| | | | | |
|---|---|---|---|---|
| 3,531,077 | A * | 9/1970 | Trottier et al. | 248/370 |
| 4,505,012 | A | 3/1985 | Johnson | |
| 4,665,641 | A * | 5/1987 | Llames | 42/85 |
| 5,074,069 | A | 12/1991 | Shire | |
| 5,075,996 | A | 12/1991 | Llames | |
| 5,303,859 | A * | 4/1994 | Jenkin | 224/149 |
| 5,305,540 | A | 4/1994 | Blenk | |
| 5,575,411 | A | 11/1996 | Hightower | |
| 6,363,532 | B1 | 4/2002 | Miller | |
| 6,598,330 | B2 * | 7/2003 | Garrett et al. | 42/85 |
| 7,082,709 | B2 | 8/2006 | Lindsey | |
| 7,950,551 | B2 | 5/2011 | Thompson | |
| 8,312,662 | B2 | 11/2012 | Rogers | |
| 2005/0268516 | A1 * | 12/2005 | Nelson | 42/73 |
| 2009/0288325 | A1 * | 11/2009 | Esch | 42/85 |
| 2011/0017788 | A1 * | 1/2011 | Haley et al. | 224/150 |
| 2011/0138671 | A1 * | 6/2011 | Rogers et al. | 42/85 |
| 2011/0239512 | A1 * | 10/2011 | Kleven | 42/85 |

* cited by examiner

*Primary Examiner* — Samir Abdosh
*Assistant Examiner* — John D Cooper
(74) *Attorney, Agent, or Firm* — Law Office of Andrei D Popovici, PC

(57) ABSTRACT

In some embodiments, a revolving sling mount for a rifle (e.g. AR-15/M4/M16) includes a stack comprising a fixed plate configured to be secured to the rifle in a fixed position, a revolving sling-attachment plate rotatably attached to the fixed plate, and fixed ring securing the revolving sling-attachment plate between the fixed plate and stop ring. Each of the fixed plate, sling-attachment plate and stop ring defines an inner aperture sized to slide over a buttstock tube of the rifle. The revolving plate rotates relative to the fixed plate about an axis perpendicular to a major plane of the fixed plate. The revolving plate includes a sling-attachment loop for attaching a sling. One or more rotation stops constrain a rotation of the sling-attachment plate so that the sling-attachment loop does not obstruct the rearward motion of a charging handle assembly of the rifle.

12 Claims, 5 Drawing Sheets

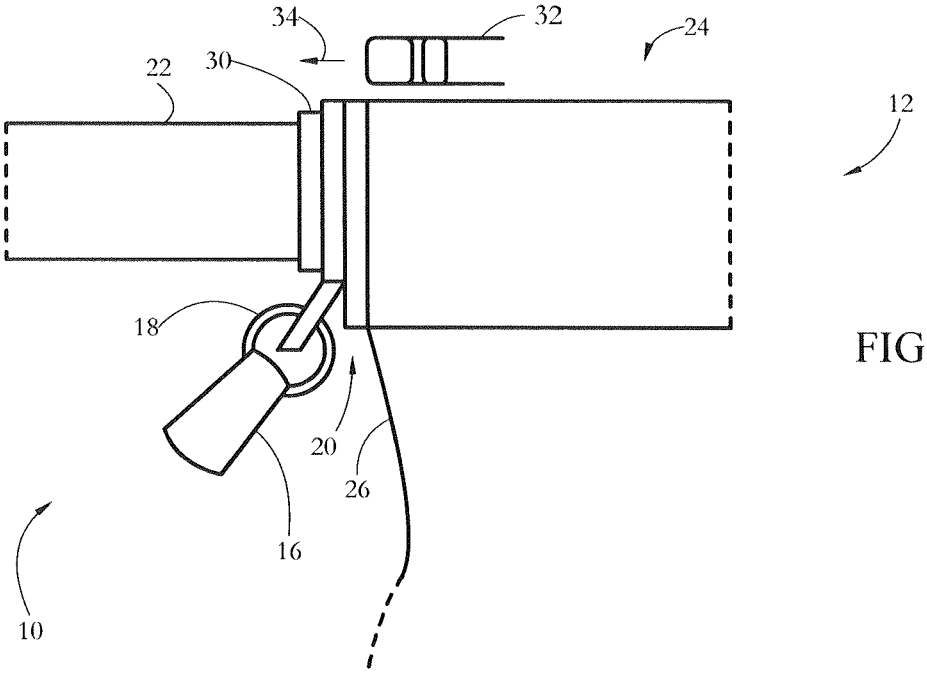
FIG. 1
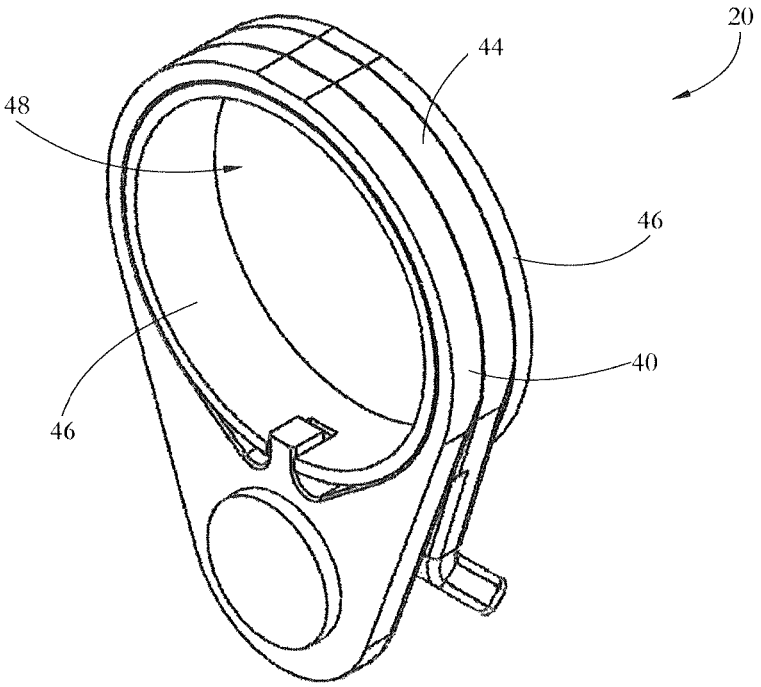
FIG. 2-A

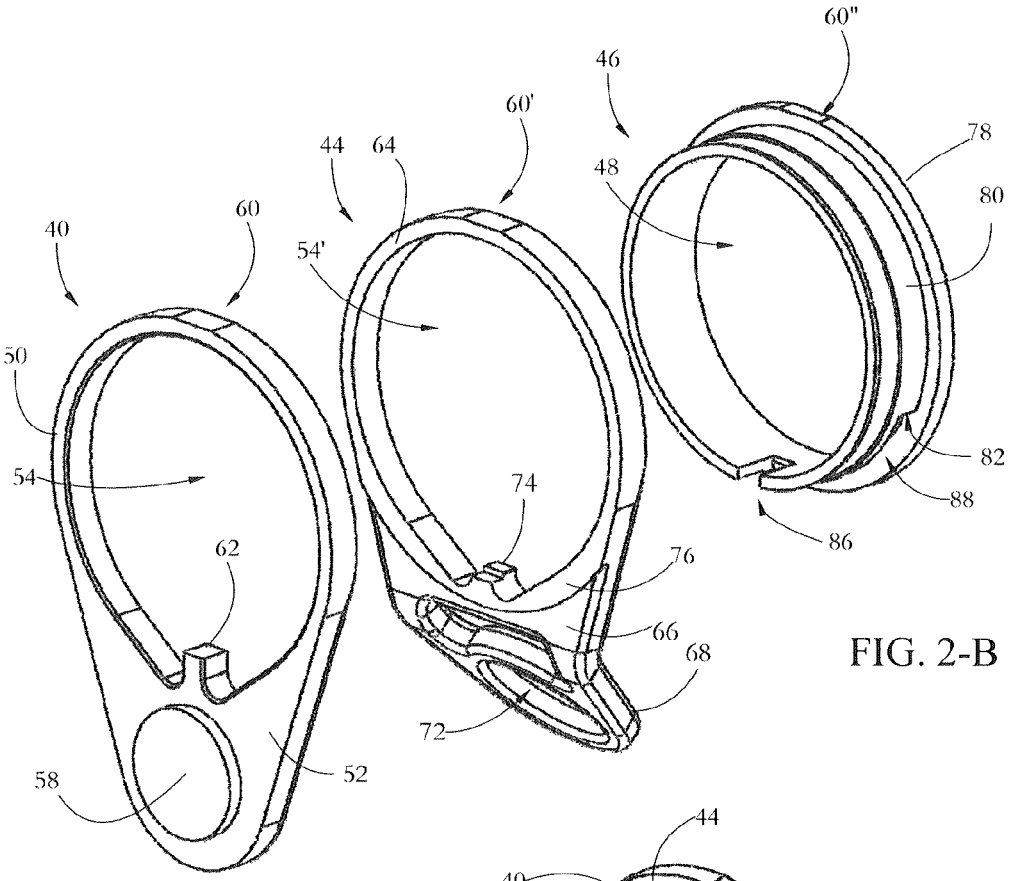
FIG. 2-B
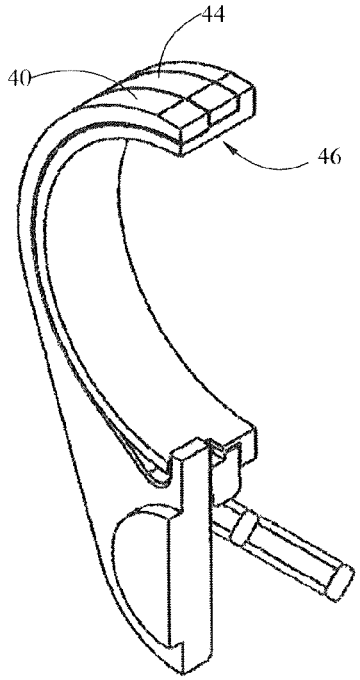
FIG. 2-C

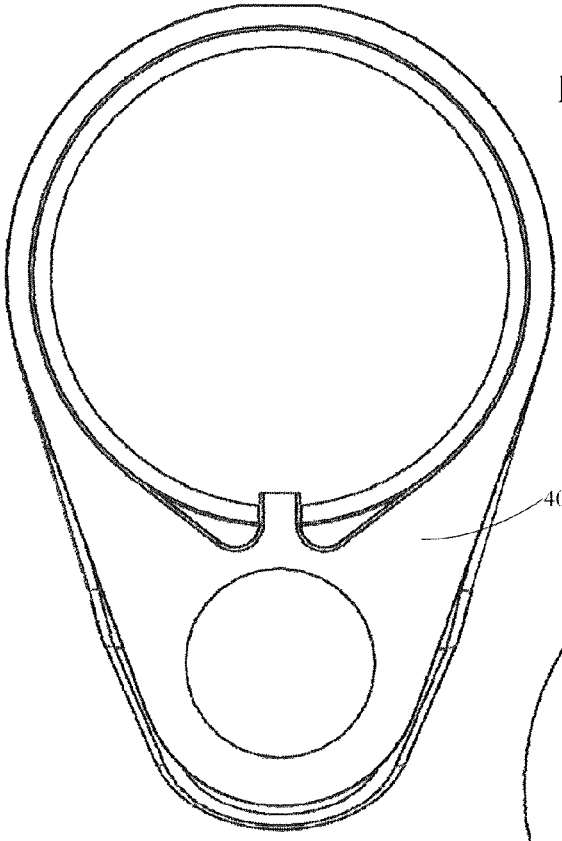
FIG. 2-D
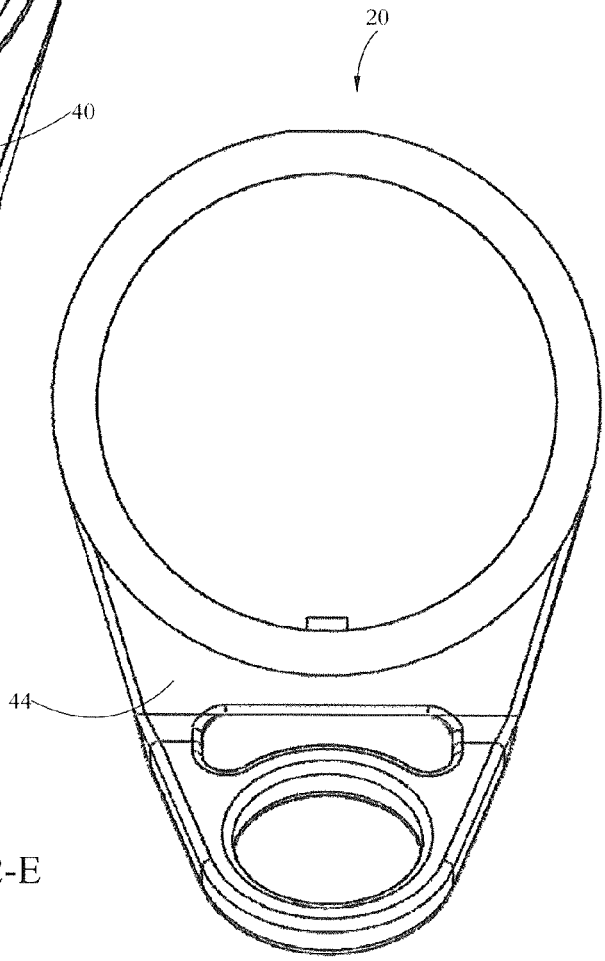
FIG. 2-E

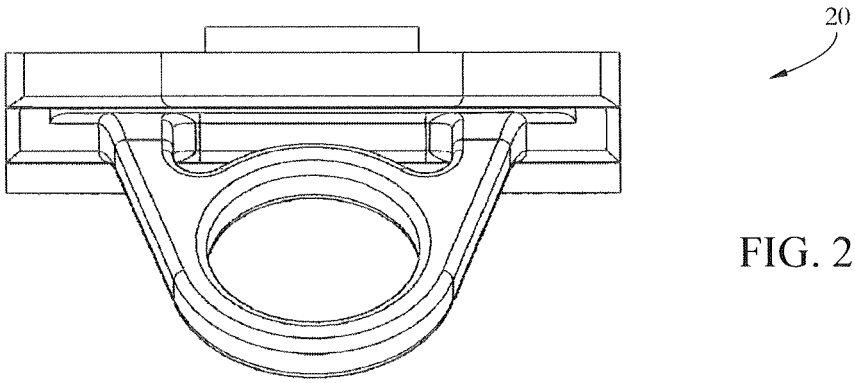
FIG. 2-F
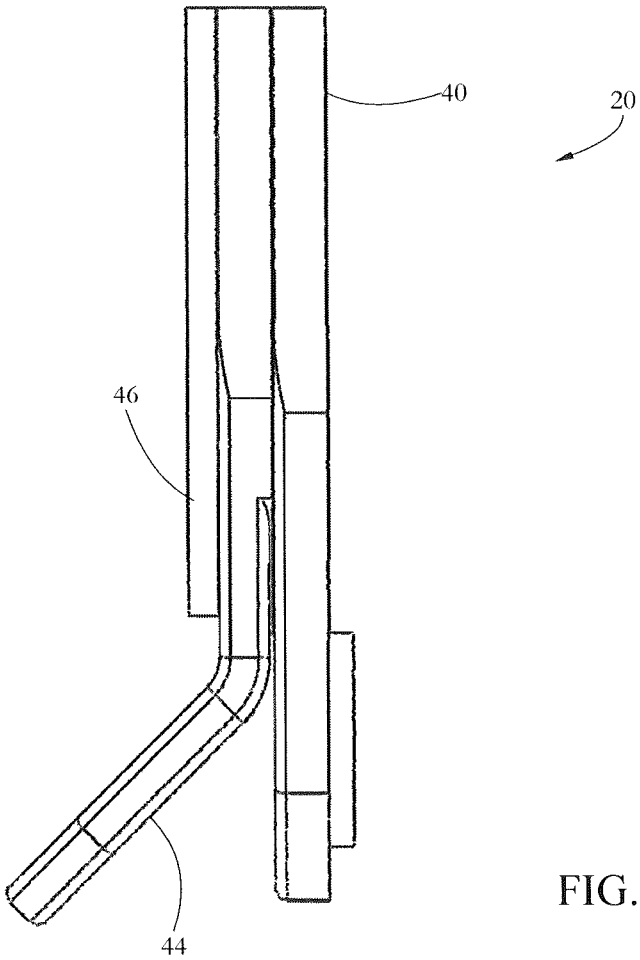
FIG. 2-G

REVOLVING REAR SLING MOUNT FOR A FIREARM

BACKGROUND OF THE INVENTION

This invention relates to firearms, and in particular to rear sling mounts for rifles.

Rifles, such as the AR-15/M4/M16, AR-10 and LR-308 rifle designs, may be held using a sling attached to the rifle. The sling may be placed around the user's neck or shoulder.

SUMMARY OF THE INVENTION

According to one aspect, a rifle assembly comprises: a rifle body defining a longitudinal axis parallel to or coinciding with a firing direction of the rifle; a sling for holding the rifle body; and a revolving sling mount connecting the sling to the rifle body. The sling mount includes: a fixed plate secured to the rifle body in a fixed position at a rear of the rifle body, the fixed plate including a fixed buttstock-attachment ring sized to slide over a buttstock tube of the rifle; and a revolving sling-attachment plate rotatably attached to and stacked onto the fixed plate, the revolving sling-attachment plate being configured to rotate relative to the fixed plate about the longitudinal axis, the revolving sling-attachment plate including a sling-attachment loop for attaching the sling.

According to another aspect, a revolving sling mount for a rifle comprises: a fixed plate configured to be secured to the rifle in a fixed position at a rear of a rifle body, the fixed plate including a fixed buttstock-attachment ring sized to slide over a buttstock tube of the rifle; and a revolving sling-attachment plate rotatably attached to and stacked onto the fixed plate, the revolving plate being configured to rotate relative to the fixed plate about an axis perpendicular to a major plane of the fixed plate, the revolving sling-attachment plate including a sling-attachment loop for attaching a sling.

According to another aspect, a revolving sling mount for a rifle comprises: a fixed rifle attachment configured to be secured to the rifle in a fixed position; and a revolving sling attachment rotatably attached to the fixed rifle attachment and configured to be attached to a sling, wherein at least one of the fixed attachment and the sling attachment comprises a rotation stop constraining a rotation of the revolving sling attachment relative to the fixed rifle attachment to a rotation span of less than a full revolution.

According to another aspect, a revolving sling mount for a rifle comprises: fixed securing means secured to the rifle body in a fixed position; and revolving sling-attachment means for connecting a rifle sling, the revolving sling-attachment means being rotatably attached to the fixed securing means, wherein at least one of the fixed securing means and the revolving sling-attachment means comprises a rotation stop constraining a rotation of the revolving sling-attachment means relative to the fixed securing means to a rotation span of less than a full revolution.

BRIEF DESCRIPTION OF THE DRAWINGS

The foregoing aspects and advantages of the present invention will become better understood upon reading the following detailed description and upon reference to the drawings where:

FIG. 1 shows a rifle assembly including a sling mount, according to some embodiments of the present invention.

FIG. 2-A shows an isometric view of a sling mount for a rifle, according to some embodiments of the present invention.

FIG. 2-B shows an exploded view of the sling mount of FIG. 2-A, according to some embodiments of the present invention.

FIG. 2-C shows a section through the sling mount of FIG. 2-A, according to some embodiments of the present invention.

FIG. 2-D shows a front view of the sling mount of FIG. 2-A, according to some embodiments of the present invention.

FIG. 2-E shows a back view of the sling mount of FIG. 2-A, according to some embodiments of the present invention.

FIG. 2-F shows a bottom view of the sling mount of FIG. 2-A, according to some embodiments of the present invention.

FIG. 2-G shows a side view of the sling mount of FIG. 2-A, according to some embodiments of the present invention.

DETAILED DESCRIPTION OF THE INVENTION

Figure 3:
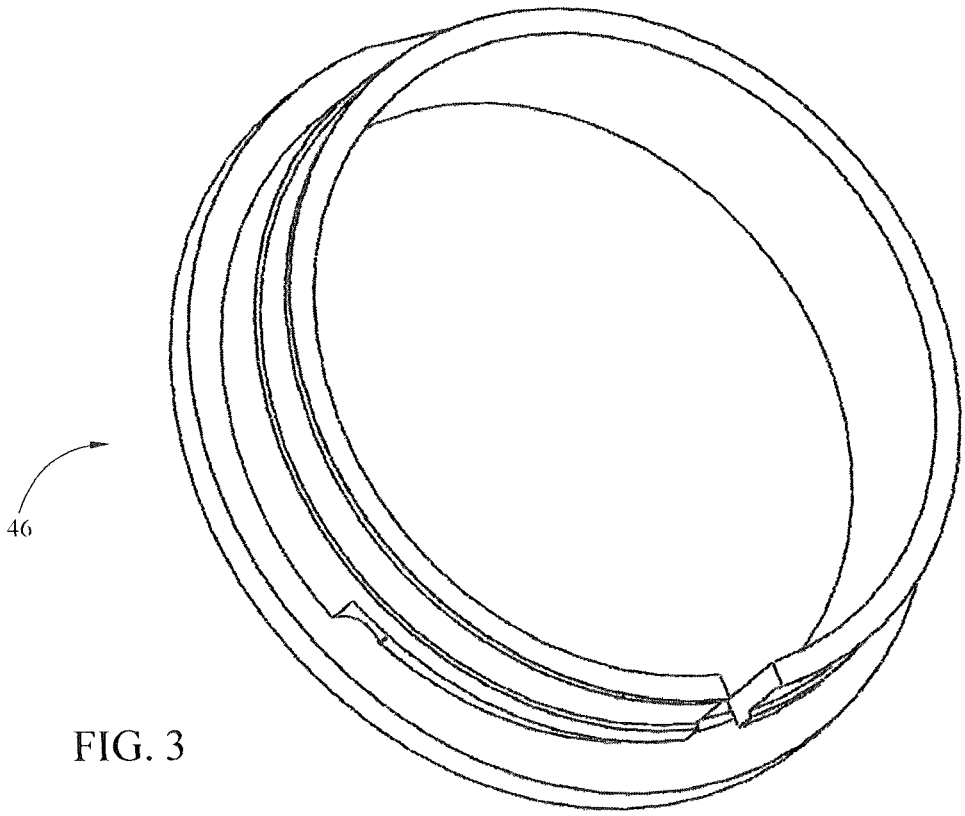
FIG. 3 shows an isometric view of a bearing insert (stop ring) of the sling mount of FIG. 2-A, according to some embodiments of the present invention.

The following description illustrates the present invention by way of example and not necessarily by way of limitation. A set of elements includes one or more elements. A plurality of elements includes two or more elements. Any recitation of an element is understood to refer to at least one element. Unless otherwise required, any described method steps need not be necessarily performed in a particular illustrated order. Unless otherwise specified, the terms "longitudinal axis" and "longitudinal" are used below to refer to an axis which coincides with or is parallel to the firing axis/direction of a rifle. The terms "rotation" and "revolution" are both used below to refer to rotation about a center, whether or not the center of rotation is also the center of the rotating element.

FIG. 1 shows a side view of a rifle assembly 10 according to some embodiments of the present invention. Rifle assembly 10 include a rifle 12, a revolving sling mount 20 attached to rifle 12, and a sling 16 attached to sling mount 20 through a detachable ring 18, for holding rifle 12. Rifle 12 points to the right in the illustration of FIG. 1, i.e. the direction of firing of rifle 12 is horizontal. Sling mount 20 is mounted facing the longitudinal axis (the direction of firing). Sling 16 may be formed by a loop of a textile material, which a rifle user may place around his/her neck or shoulder. Ring 18 may be a rounded (e.g. circular, quasi-circular or oval) clasp such as a lobster claw, carabiner or other detachable metal ring, capable of detachably connecting to an aperture formed in sling mount 20, for securing sling 16 to sling mount 20. Sling mount 20 is attached to rifle 12 at the interface between a buttstock 22 and a rifle body 24. Rifle body 24 may include an upper and/or lower receiver. The rear of the rifle grip is shown at 26 in FIG. 1. A threaded ring 30 may engage a matching thread along buttstock 22 to secure sling mount 20 between ring 30 and rifle body 24.

A charging handle assembly 32 is situated along top of rifle body 24. A user pulls charging handle assembly 32 backward, as illustrated by the longitudinal arrow 34 in FIG. 1, in order to charge rifle 12. As described below, in some embodiments a rotation span of sling mount 20 is constrained so that charging handle assembly 32 can slide over sling mount 20 regardless of the rotational position of sling mount 20, without being blocked by sling mount 20.

FIG. 2-A shows an isometric view of sling mount 20 according to some embodiments of the present invention. FIG. 2-B shows an exploded view of sling mount 20, while FIG. 2-C shows a section through sling mount 20 according to some embodiments of the present invention. As shown in FIGS. 2-A-C, sling mount 20 includes a stack formed by a fixed backing plate 40 configured to attach to rifle body 24 (FIG. 1), a revolving sling attachment (retention) plate 44 rotatably coupled to fixed backing plate 40, and a fixed stop ring (bearing insert) 46 rotatably coupled to sling attachment plate 44. A longitudinal inner aperture 48 defined by stop ring 46 is sized to allow a rifle buttstock tube, shown at 22 in FIG. 1, to slide through aperture 48. In some embodiments, each of the three components of sling mount 20 is integrally (monolithically) formed from a single piece of material. In some embodiments, each of the three components may be formed from two or more piece of material welded or otherwise securely fastened together.

Fixed backing plate 40 and stop ring 46 are fixed relative to rifle body 24 (FIG. 1), with the major plane of fixed backing plate 40 substantially perpendicular to the longitudinal axis. Sling attachment plate 44 is positioned between fixed backing plate 40 and stop ring 46 and is capable of revolving relative to fixed backing plate 40, around the centerline of the action of the rifle. In some embodiments, for example for AR-15/M4/M16 rifles, the range of rotation is constrained to a predetermined rotation span (range), in order to prevent a sling-attachment loop 68 from obstructing the rearward motion of charging handle assembly 32. For example, the rotation span may be defined so that sling-attachment loop 68 cannot go higher than horizontal relative to a rifle being held in a horizontal position. In other embodiments, for example for shotguns or other rifles in which attachment loop 68 does not obstruct a charging handle or other relevant rifle structure, the range of rotation of sling attachment plate 44 may be unconstrained, and sling attachment plate 44 may be capable of one or more full revolutions relative to fixed backing plate 40.

As shown in FIG. 2-B, fixed backing plate 40 includes a circular buttstock-attachment ring 50, and a generally-planar contact section 52 extending downward from buttstock-attachment ring 50. Ring 50 defines a central longitudinal aperture 54 sized to extend over a corresponding annular inner extension of stop ring 46. A circular alignment stub 58 protrudes longitudinally from the frontal side of contact section 52. Alignment stub 58 fits in a matching circular opening defined in rifle body 24 (FIG. 1), to lock sling mount 20 into place by preventing the rotation or other transverse motion of fixed backing plate 40 relative to rifle body 24. A clearance flat 60 is defined by a cutout along the top surface of ring 50. Clearance flat 60 provides space for the unobstructed passage of charging handle assembly 32 when charging handle assembly is pulled backward, over sling mount 20. A lock tab 62 protrudes transversely from the top surface of contact section 52, into the internal space defined within ring 50. Lock tab 62 engages a corresponding channel defined in stop ring 46, facilitating the alignment and fixed attachment of stop ring 46 to fixed backing plate 40. Lock tab 62 may also engage a corresponding channel defined in buttstock 22 (FIG. 1), to help secure fixed backing plate 40 to buttstock 22.

Revolving sling-attachment plate 44 includes a circular buttstock-attachment ring 64, a slanted, circular sling-attachment loop 68, and a generally-planar linking section 66 linking buttstock ring 64 and sling-attachment loop 68. Ring 64 defines a central longitudinal aperture 54' sized to extend over a corresponding annular inner extension of stop ring 46. Sling attachment loop 68 defines an inner circular aperture 72. Sling attachment loop 68 may be used to establish a link to a flexible sling using a clasp, as described above. Sling attachment loop 68 is slanted relative to the plane perpendicular to the longitudinal direction. A clearance flat 60' cut out of the top surface of buttstock-attachment ring 64 provides additional space for the unobstructed passage of charging handle assembly 32, as described above. A stop tab 74 protrudes transversely from the top surface of linking section 66, into the internal space defined within buttstock-attachment ring 64. Stop tab 74 engages corresponding internal rotation stop features defined along a side surface of stop ring 46, in order to constrain the rotation of sling-attachment plate within limits defined by the rotation stops. A raised friction area 76 is defined along the bottom front edge of buttstock-attachment ring 64. Friction area 76 limits the contact area between fixed backing plate 40 and sling-attachment plate 44, and in particular reduces the contact outside friction area 76.

Stop ring 46 includes an annular insert 80 sized to contact the inner surfaces of buttstock-attachment rings 50, 64, and a flared rear annular lip 78 which contacts the rear surface of buttstock-attachment ring 64. Stop ring 46 defines a central longitudinal aperture 48 sized to accommodate buttstock tube 22. A clearance flat 60" cut out of the top surface of annular lip 78 provides additional space for the unobstructed passage of charging handle assembly 32, as described above. A pair of internal rotation stops 82 define the ends of a recessed internal rotation channel 88 along the outer surface of annular insert 80. Rotation stops 82 contact stop tab 74 of sling attachment plate 44 to prevent the further rotation of sling attachment plate 44 relative to stop ring 46. A longitudinal channel 86 is defined along the bottom of annular insert 80, and is sized to accommodate lock tab 62 of fixed backing plate 40, facilitating the alignment and fixed attachment of stop ring 46 to fixed backing plate 40.

FIGS. 2-D, 2-E, 2-F and 2-G show front, back, bottom and side views, respectively, of sling mount 20 according to some embodiments of the present invention. FIG. 3 shows an isometric view of a bearing insert (stop ring) of sling mount 20 according to some embodiments of the present invention.

The components of sling mount 20 described above may be formed individually from one or more materials that is/are sufficiently strong and reliable for firearm use. Such materials may include steel (e.g. 4040 alloy steel), titanium, or polymeric materials. In some embodiments, the three components are formed from 4040 alloy steel and welded or press-fitted together into a union that allows for the rotation of sling-attachment plate 44.

Conventional sling attachments may make it difficult to switch the rifle between right-hand/right/shoulder and left-hand/left-shoulder operation. For example, a simple clasp attachment may lead to the sling becoming twisted or entangled with the rifle as the user switches the position of the rifle between the left and right sides of his/her body. A rotatable sling-mount as described above allows a user to easily switch between right- and left-handed operation of the rifle, without twisting the sling or blocking the rearward motion of a rifle charging handle assembly.

To use sling mount 20, a user connects sling mount 20 to a rifle, attaches two ends of a sling to sling mount 20 as described above, and places the sling around the user's neck or shoulder. During operation of the rifle, as the user switches the weapon between his/her right and left sides, sling attachment plate 44 rotates relative to the rifle, allowing the rifle to move seamlessly, without causing the sling to become entangled with the rifle or otherwise twisted or bound up. For rifles having a charging handle assembly which may be retracted to a position immediately above sling mount 20, a constrained-rotation sling mount may be used to allow the user to pull back the charging handle without obstruction by sling-attachment loop 68.

The above embodiments may be altered in many ways without departing from the scope of the invention. In particular, in some embodiments the particular configurations described above may be altered while still allowing rotation of the sling-attachment member relative to a rifle-attachment member. For example, in some constrained-rotation embodiments, rather than defining a rotation stop tab (shown at 74 in FIG. 2-B) on the sling-attachment member, and defining a channel and corresponding rotation stops (shown at 88 and 82, respectively, in FIG. 2-B) on a rifle-attached member, a protrusion may be provided on a rifle-attached member, and a corresponding channel and/or rotation stops may be provided on the sling-attachment member. In some embodiments, a revolving sling attachment plate (shown at 44 in FIG. 2-B) or other components described above may be formed from two distinct pieces secured together; in the case of a sling attachment plate, for example, a sling attachment loop and buttstock attachment ring as described above may be formed form distinct metal pieces welded or otherwise securely fastened together to form a sling attachment plate. In some embodiments, structures other than lock tab 62 (FIG. 2-B) and threaded ring 30 (FIG. 1) may be used to secure the sling mount to a rifle. For example, a lock tab or other keyed structure can be provided on the rifle, a matching keying aperture may be provided on the sling mount, and a clamp or other fastener may be used to secure the sling mount in place on the rifle. A sling mount as described above may also be attached to a firearm at different locations than the interface between a rifle body and buttstock. Additionally, in some embodiments, a sling mount may include only two members rotatable with respect to each other, rather than three members as described in the preferred embodiments above. Accordingly, the scope of the invention should be determined by the following claims and their legal equivalents.

What is claimed is:

1. A firearm assembly comprising:

a firearm comprising a firearm body and a buttstock, the buttstock defining a longitudinal axis parallel to or coinciding with a firing direction of the firearm, the buttstock comprising a buttstock tube extending rearwardly from the firearm body along the longitudinal axis;

a sling for holding the firearm; and a revolving sling mount connecting the sling to the firearm body, the revolving sling mount including:

a fixed plate secured to the firearm in a fixed position at a rear of the firearm body, the fixed plate including a fixed ring sized to slide over the buttstock tube; and a revolving sling-attachment plate rotatably attached to and stacked onto the fixed plate, the revolving sling-attachment plate including a ring sized to slide over the buttstock tube, the revolving sling-attachment plate being configured to rotate relative to the buttstock tube and the fixed plate about the longitudinal axis while the fixed plate is in a fixed position relative to the buttstock tube, the revolving sling-attachment plate including a sling-attachment loop for attaching the sling.

2. The firearm assembly of claim 1, wherein at least one of the fixed plate and the revolving sling-attachment plate includes a rotation stop constraining a rotation span of the revolving plate relative to the fixed plate to less than a full revolution.

3. The firearm assembly of claim 2, wherein the rotation span is sized and oriented to prevent the sling-attachment loop from blocking a rearward motion of a charging handle assembly of the firearm.

4. The firearm assembly of claim 1, wherein the sling-attachment loop is slanted at a fixed slant angle relative to a plane perpendicular to the longitudinal axis.

5. The firearm assembly of claim 1, wherein the firearm body is a rifle body.

6. The firearm assembly of claim 1, wherein the fixed ring of the fixed plate includes a clearance flat cut out of a top surface of the fixed ring for providing space for a rearward motion of a charging handle assembly of the firearm.

7. A revolving sling mount for a firearm, comprising:

a fixed plate configured to be secured to the firearm in a fixed position at a rear of a firearm body, the fixed plate including a fixed ring sized to slide over a buttstock tube extending from the rear of the firearm body, the buttstock tube extending along a longitudinal axis parallel to or coinciding with a firing direction of the firearm; and a revolving sling-attachment plate rotatably attached to and stacked onto the fixed plate, the revolving sling-attachment plate including a ring sized to slide over the buttstock tube, the revolving sling-attachment plate being configured to rotate relative to the buttstock tube and the fixed plate about an axis perpendicular to a major plane of the fixed plate while the fixed plate is in a fixed position relative to the buttstock tube, the revolving sling-attachment plate including a sling-attachment loop for attaching a sling.

8. The revolving sling mount of claim 7, wherein at least one of the fixed plate and the revolving sling-attachment plate includes a rotation stop constraining a rotation span of the revolving plate relative to the fixed plate to less than a full revolution.

9. The revolving sling mount of claim 8, wherein the rotation span is sized and oriented to prevent the sling-attachment loop from blocking a rearward motion of a charging handle assembly of the firearm.

10. The revolving sling mount of claim 7, wherein the sling-attachment loop is slanted at a fixed slant angle relative to a major plane of the fixed plate.

11. The revolving sling mount of claim 7, wherein the firearm is a rifle.

12. The sling mount of claim 7, wherein the fixed ring of the fixed plate includes a clearance flat cut out of a top surface of the fixed ring for providing space for a rearward motion of a charging handle assembly of the firearm.

* * * * *